US007210315B2

(12) United States Patent
Castelli et al.

(10) Patent No.: US 7,210,315 B2
(45) Date of Patent: May 1, 2007

(54) WATER DISTRIBUTOR FOR AN AUTOMATIC LAUNDRY OR DISHWASHING MACHINE

(75) Inventors: Paolo Castelli, Venegono Sup. (IT); Giorgio Zambon, Jerago Con Orago (IT)

(73) Assignee: Whirlpool Corporation, Benton Harbor, MI (US)

( * ) Notice: Subject to any disclaimer, the term of this patent is extended or adjusted under 35 U.S.C. 154(b) by 550 days.

(21) Appl. No.: 10/241,182

(22) Filed: Sep. 11, 2002

(65) Prior Publication Data

US 2003/0051513 A1 Mar. 20, 2003

(30) Foreign Application Priority Data

Sep. 14, 2001 (EP) ..... 01121692

(51) Int. Cl.
*D06F 39/02* (2006.01)

(52) U.S. Cl. ..... 68/12.18; 68/17 R

(58) Field of Classification Search ..... 134/56 R, 134/57 R, 58 R, 93, 94.1; 68/12.18, 17 R
See application file for complete search history.

(56) References Cited

U.S. PATENT DOCUMENTS

| | | | | |
|---|---|---|---|---|
| 4,884,780 | A * | 12/1989 | Ohashi | 251/11 |
| 4,887,430 | A * | 12/1989 | Kroll et al. | 60/527 |
| 2004/0118434 | A1* | 6/2004 | Virgilio et al. | 134/18 |

FOREIGN PATENT DOCUMENTS

| | | | |
|---|---|---|---|
| DE | 1812455 | A | 7/1970 |
| DE | 19857647 | A1 * | 6/2000 |
| DE | 19947324 | A | 4/2001 |
| EP | 1029965 | A1 * | 8/2000 |
| GB | 2188704 | A | 10/1987 |
| JP | 60188676 | A * | 9/1985 |
| JP | 60196482 | A * | 10/1985 |
| JP | 07027251 | A * | 1/1995 |

OTHER PUBLICATIONS

English translation of EP 1029965.*
http://www.ehag.ch/PDF-Files/Dynalloy/HP-Dynalloy.pdf, May 24, 1999.*
http://www.dynalloy.com/index.html.*
Electronic translation of JP 07-027251.*
Electronic translation of DE 1813455.*

* cited by examiner

*Primary Examiner*—Joseph L. Perrin
(74) *Attorney, Agent, or Firm*—Robert O. Rice; Stephen Krefman; John F. Colligan

(57) ABSTRACT

A water distributor for an automatic laundry or dishwashing machine, comprises a water inlet that is controllable by a programming device of the machine and a movable element controllable by said programming device which serves for supplying water to a predetermined detergent dispenser for carrying a selected detergent towards the washing tub according to the washing program of the machine. The movable element is driven through a shape memory alloy wire electrically connected to a drive circuit that is part of the programming device.

10 Claims, 3 Drawing Sheets

WATER DISTRIBUTOR FOR AN AUTOMATIC LAUNDRY OR DISHWASHING MACHINE

BACKGROUND OF THE INVENTION

1. Field of the Invention

The present invention relates to a water distributor for an automatic laundry or dish-washing machine comprising a water inlet that is controllable by a programming device of the machine and a movable element, controllable by said programming device, which serves for supplying water to one of detergent or additive dispensers for carrying the detergent or additive towards the washing tub according to the washing programme of the machine.

2. Description of the Related Art

The known water distributors have a movable element that is usually driven by an electric motor. This system is implemented using the existing motor on the electromechanical or hybrid timers by means of a wire. For washing machines provided with electromechanical timers, the motor is already included in the system. For washers equipped with a full electronic control, a motor for controlling the water distribution is added and a feedback of the selected dispenser is required.

The movable element can be a simple lever carrying a water nozzle which directs the water toward one of the detergent dispenser, or it can be a rotating distributor having channels for conveying water to different detergent dispensers according to the angular position of the rotating distributor. With the term "detergent" we mean all the products (detergent, washing or rinsing aid, softeners etc.) which are usually added during the washing and/or rinsing process of the machine. The cost of known water distributors is presently high due to both the costs of the motor and of its feedback control system. Moreover the mechanical system for moving the movable element is quite complicated and therefore its reliability is not very high.

SUMMARY OF THE INVENTION

One of the objects of the present invention is to provide a new water distributor that is of low cost and is of high reliability if compared to the water distributors known up to now.

In the water distributor according to the invention the movable element is driven through a shape memory alloy (SMA) wire. The use of a SMA wire (known also as "muscle wire", since the wire acts as muscle while current flows and the wire becomes shorter exerting a stretching) controlled by the programming device of the machine reduces the cost of the water distributor.

Moreover the SMA wire offers several other advantages for the distribution system actuation versus the existing solutions:

no feedback is required;

reliable, because millions of operations are guaranteed if the SMA wire is used within the specified ranges;

noiseless, because, differently than a motor, the actuation does not generate any noise;

faster than a motor, because the movement can be reversed (today motors turn in one direction only so one revolution is required to reach the previous position);

well suitable for manufacturing (do not required fine tuning, less number of parts to assembly).

With the term SMA we mean all the metal alloys that undergo changes in shape when heated or cooled. Among SMA, the most common alloys are nickel and titanium alloys ("nitinol") and other alloys as copper-aluminium-nickel, copper-tin, copper-zinc, copper-gold-zinc, copper-zinc-aluminium, iron-platinum, nickel-aluminum, and manganese-copper. According to the present invention, it is preferred to use alloys for use at room temperature (around 20° C.), having a transition temperature range from 70° C. to 95° C. This transition temperature can be easily reached through Joule effect, i.e. by heating the SMA wire through electric current. The force exerted by the wire depends on its section and driving current. The SMA wires offer the possibility to move the movable element of the distribution system, which diverts the water flow to the different dispensers or chambers.

BRIEF DESCRIPTION OF THE DRAWINGS

The following description and drawings illustrate one example of the device for a machine in accordance with the invention.

DESCRIPTION OF THE PREFERRED EMBODIMENT

Figure 1:
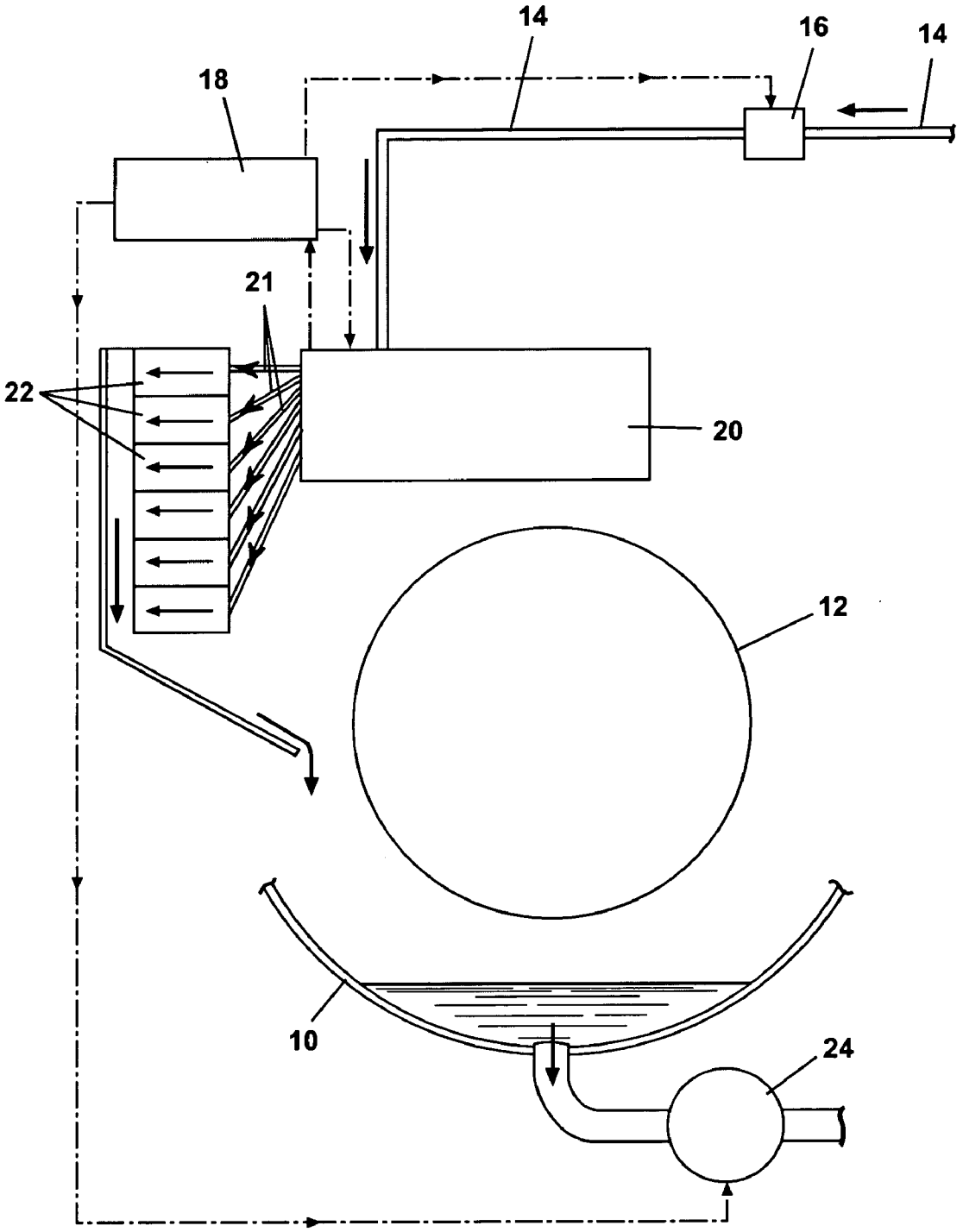
FIG. 1 is a schematic view of a clothes washing machine provided with a water distributor.

In FIG. 1 a tub 10 of a washing machine is shown, in which is rotatably mounted a drum 12. Water is supplied through a pipe 14 on which an on/off electrical valve 16 is mounted. An electromechanical or electronic control unit 18 of the machine controls such valve. Downflow the valve 16, the pipe 14 feeds water to a water distributor device 20 controlled by the control unit 18 and which is adapted to discharge a water flow to different dispensers 22 for detergents or washing/rinsing aids. The different "direction" of the water flow towards dispensers 22 is schematically shown in FIG. 1 by means of arrows 21. The water flow entrains the detergent and a mixture of water plus detergent is fed into the tub 10. The liquid from the tub 10 is then discharged (after washing or rinsing) by means of a pump 24.

Figure 2:
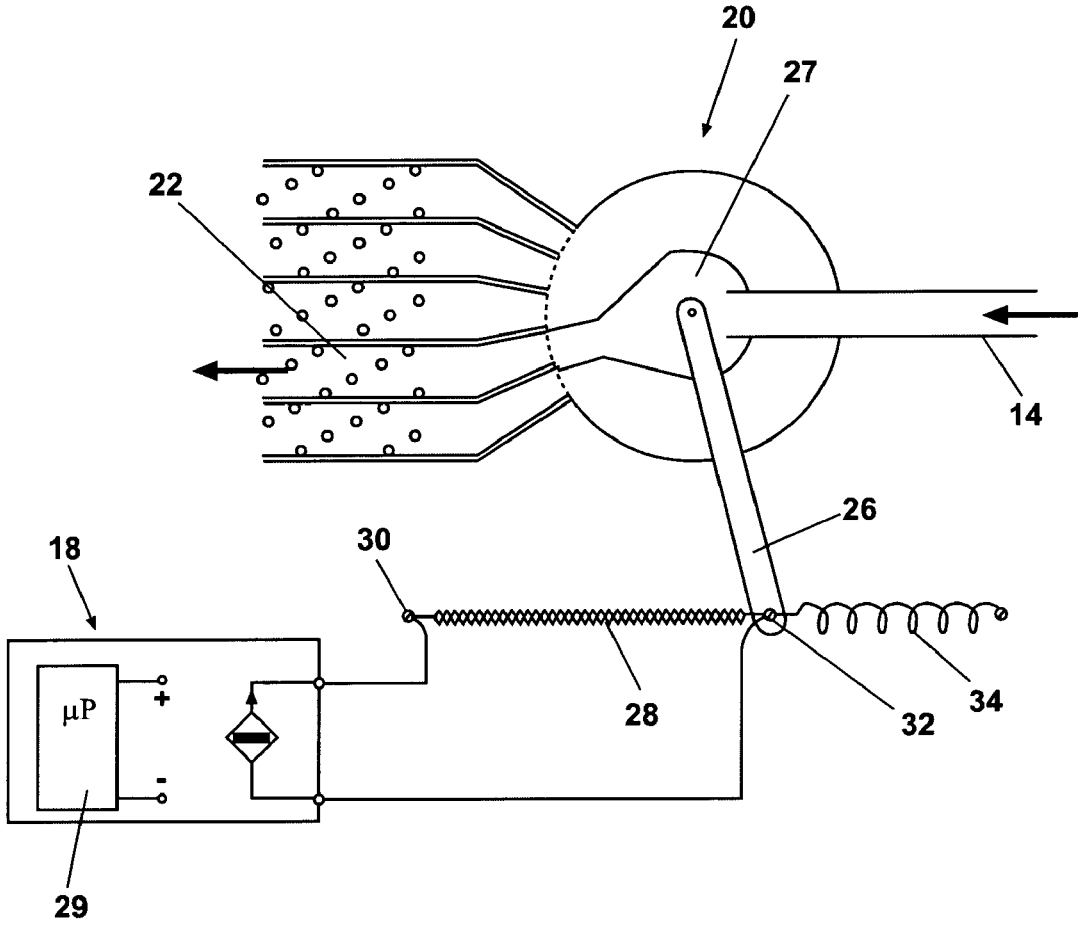
FIG. 2 is a view of the water distributor according to the present invention with an DC driver (analog)

In FIG. 2 an example of a water distributor according to the present invention is shown, in which the movement of a lever 26 which turns the nozzle 27 is carried out by reducing the length of a SMA wire 28.

SMA length reduction is obtained by current flowing through the SMA from terminal 30 to terminal 32 or vice versa.

SMA length reduction can be controlled by changing the current flow in a "linear" range getting different lengths as function of the current; outside of this "linear" range the length reduction is the maximum achievable and the wire is fully contracted. The control of the SMA wire 28 is carried out through a microprocessor 29 that is part of the control unit 18.

The SMA wire is preferably made of Austenite or Martensite (Flexinol-conflex Flex 025, 037, 050, 100, 150, 250, 300, 375), has a resistance of 8 to $1770^{Ohm}/_{m}$ at ambient temperature, and has a cross section of 490 to 110450 $\mu m^2$.

A current flow of 20 mA to 3 A increases the temperature of the wire from ambient temperature to 68° C.–98° C., therefore reducing its length of a maximum of 8%. The strain of the wire is used to move the lever 26 generating a rotation of the nozzle 27 that diverts the water from one chamber 22 of the dispenser to a different one.

To take back the lever 26 the current is changed or removed and the tension of the spring (34) brings back the lever 26 to another position or to the previous one.

Figure 3:
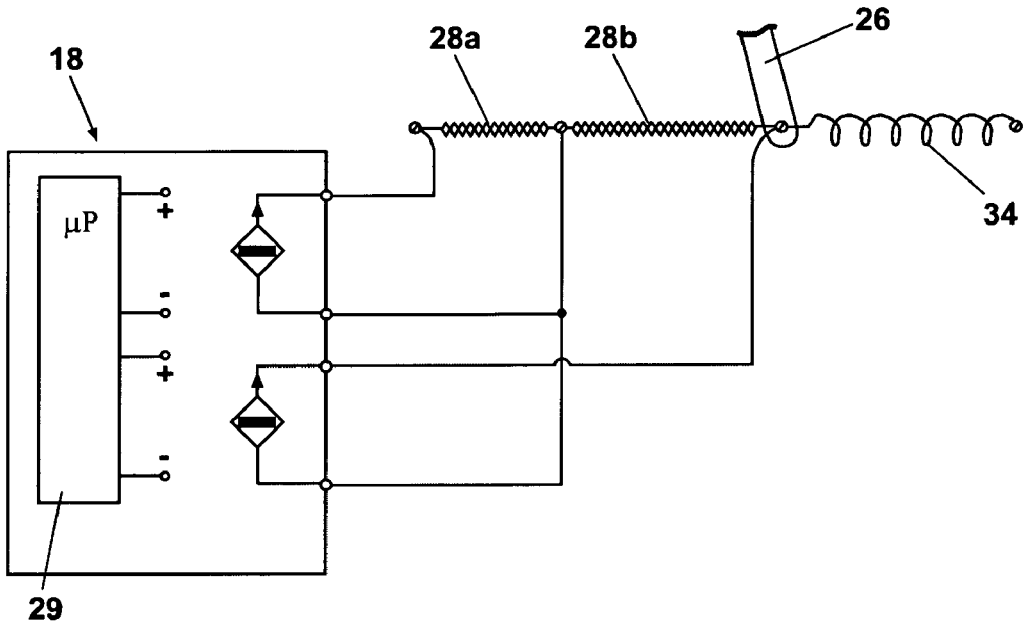
FIG. 3 is a view of the digital driving mode to control the lever position (digital) with a n-wires system to get $2^n$ total length for the different positions (the figure shows only the 2 wires case)

In FIG. 3 a second embodiment of a water distributor according to the present invention is shown. In this embodiment the water distributor is used to get different discrete number of positions so a different number of dispenser chambers 22 can be either managed.

Each SMA is driven with the maximum current to get the full stretch, that is, the driving method is 'digital' (no current or full current). The advantage is that length reduction is predictable being related to the relaxed length so position feedback is not required.

The total length reduction is the sum of the length reduction of the SMA that are driven; intermediate positions can be achieved by appropriate activation of each SMA wire.

In a system with 'n' SMA wires up to $2^n$ different length can be generated by appropriate selection of the length of each wire.

For example, in FIG. 3, the SMA wire 28 is split in two parts 28*a* and 28*b*. The length of one part 28*b* is double than the length of the other 28*a* to get a binary weight. The electrical driving system is simplified and can be easily controlled by a microprocessor+digital driver.

Figure 4:
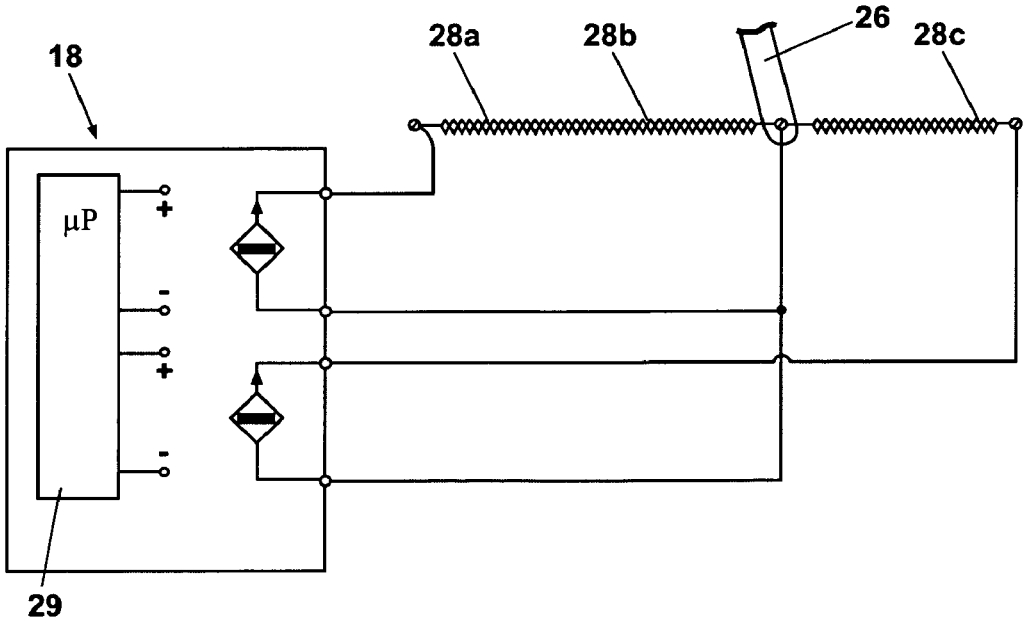
FIG. 4 is a view of the application of two wires to get a better position control replacing the spring by an additional wire.

In FIG. 4 an example according to a third embodiment is shown replacing the recovering spring of the first embodiment (FIG. 2) by another SMA 28*c* to get the continuous position control.

We claim:

1. A washing machine having a water distributor, comprising:

a washing tub;

a water inlet;

a programming device for controlling a washing program of the washing machine;

a movable element serving to selectively supply a water flow from the water inlet to a plurality of detergent dispenser chambers for carrying a selected detergent solution to the washing tub; and a series combination of at least two shape memory alloy wires connected to the movable element, each of the wires being controllable to one of a substantially fully activated state and a substantially inactivated state by the programming device in order for the movable element to reach at least three discrete positions wherein each of the at least three discrete positions of the movable element corresponds to one of the plurality of detergent dispenser chambers.

2. The washing machine of claim 1, wherein the at least three discrete positions of the movable element includes a first position, a second position and at least one intermediate position between the first position and the second position.

3. The washing machine of claim 2, wherein the first position of the movable element is achieved with all of the at least two shape memory alloy wires in the inactivated state.

4. The washing machine of claim 3, wherein the first position is achieved by a tension spring attached to the movable element.

5. The washing machine of claim 2, wherein the second position of the movable element is achieved when all of the at least two shape memory alloy wires are in a fully activated state.

6. The washing machine of claim 2, wherein the at least one intermediate position is achieved when at least one of the wires is fully activated and at least one of the wires is inactivated.

7. The washing machine of claim 1, wherein two shape memory alloy wires are utilized, the length of one wire being double the length of the other wire.

8. The washing machine of claim 1, wherein the movable element is a lever connected to a nozzle to divert water to the selected detergent dispenser chamber.

9. The washing machine of claim 1, wherein the fully activated state comprises driving the shape memory alloy wire with a current level sufficient to enable a full change in length.

10. The washing machine of claim 1, wherein the fully activated state results in a length change of the shape memory alloy wire that is substantially equal to the full length change available.

* * * * *